US005396210A

United States Patent [19]

Purohit et al.

[11] Patent Number: 5,396,210

[45] Date of Patent: Mar. 7, 1995

[54] DRY-TYPE TRANSFORMER AND METHOD OF MANUFACTURING

[75] Inventors: Dilip R. Purohit, Charlotte; Timothy A. Soter, Monroe; Jeewan Puri, Matthews, all of N.C.

[73] Assignee: Square D Company, Palatine, Ill.

[21] Appl. No.: 32,954

[22] Filed: Mar. 17, 1993

[51] Int. Cl.[6] ..... H01F 27/08

[52] U.S. Cl. ..... 336/60; 336/205; 336/206; 336/196

[58] Field of Search ..... 336/60, 205, 206, 196

[56] References Cited

U.S. PATENT DOCUMENTS

| | | | |
|---|---|---|---|
| 3,203,823 | 8/1965 | Grimes | 117/38 |
| 3,246,271 | 4/1966 | Ford | 336/94 |
| 4,039,990 | 8/1977 | Philp | 336/60 |
| 4,173,747 | 11/1979 | Grimes et al. | 336/60 |
| 4,337,569 | 7/1982 | Pierce | 29/605 |
| 4,488,134 | 12/1984 | Pfeiffer | 336/58 |
| 4,496,926 | 1/1985 | Kubo et al. | 336/205 |
| 4,649,640 | 3/1987 | Ito et al. | 29/605 |
| 4,663,604 | 5/1987 | VanSchaick et al. | 336/96 |
| 5,036,580 | 8/1991 | Fox et al. | 29/605 |

*Primary Examiner*—Leo P. Picard
*Assistant Examiner*—L. Thomas
*Attorney, Agent, or Firm*—Michael J. Femal; Richard J. Graefe; Larry I. Golden

[57] ABSTRACT

A dry type transformer has an iron core, high voltage windings embedded in cast resin, and low voltage windings resin encapsulated. The low voltage winding is constructed with flexible sheet conductors. Insulating material includes an apparatus to secure the windings in place during a vacuum and pressure resin impregnation process. The result is a coil that exhibits high short circuit protection due to the tightly bond conductors comparable to completely resin encased molded transformers at a substantially reduced cost.

18 Claims, 5 Drawing Sheets

DRY-TYPE TRANSFORMER AND METHOD OF MANUFACTURING

DESCRIPTION

RELATED APPLICATIONS

This application is related to the following, commonly assigned applications filed concurrently herewith, entitled "Method of Manufacturing a Strip Wound Coil to Eliminate Lead Bulge" Ser. No. 08/032,371, Our Docket MON-02); "High Strength Strip Wound Coil" Ser. No. 08/032,218, Our Docket MON-03); "Method of Manufacturing a Strip Wound Coil to Reinforce Edge Layer Insulation" Ser. No. 08/032,225, Our Docket MON-04); and "Method of Manufacturing a Laminated Coil to Prevent Expansion During Coil Loading" Ser. No. 08/032,224, Our Docket MON-05). The contents of these applications are expressly incorporated herein by reference.

1. Technical Field

Applicant's invention relates generally to dry type transformers having an iron core, a high voltage winding embedded in cast resin, and a low voltage winding, and more particularly to a method of manufacturing the low voltage winding.

2. Background Art

Dry type transformers with primary voltages over 600 volts have generally been constructed using one of three types of techniques, conventional dry, resin encapsulated, or solid cast. The conventional dry method uses some form of vacuum impregnation with a solvent type varnish on a completed assembly consisting of the core and the coils or individual primary and secondary coils. Some simpler methods required just dipping the core and the coils in varnish without the benefit of a vacuum. The resulting voids or bubbles in the varnish that are inherently a result of this type of process due to moisture and air, does not lend itself to applications above 600 volts. The resin encapsulated method encapsulates a winding with a resin with or without a vacuum but does not use a mold to contain the resin during the curing process. This method does not insure complete impregnation of the windings with the resin and therefore the turn to turn insulation and layer insulation must provide the isolation for the voltage rating without consideration of the dielectric rating of the resin. The solid cast method utilizes a mold around the coil which is the principal difference between it and the resin encapsulated method. The windings are placed in the mold and impregnated and/or encapsulated with a resin under a vacuum, which is then allowed to cure before the mold is removed. Since all of the resin or other process material is retained during the curing process, there is a greater likelihood that the windings will be free of voids, unlike the resin encapsulated method whereby air can reenter the windings as the resin drains away before and during curing. Cooling channels can be formed as part of the mold. One type of such a transformer is manufactured by Square D Company under the trademark of Power-Cast transformers. Another example of a cast resin transformer is disclosed in U.S. Pat. No. 4,488,134.

Since the resin coating on solid cast coils results in a solid bond between adjacent conductors than is possible with resin encapsulated coils, solid cast coils exhibit better short circuit strength of the windings. Because the conductors in the coils are braced throughout by virtue of the solid encapsulant there is less likelihood of movement of the coils during short circuit conditions and short circuit forces are generally contained internally. External bracing, foil-wound coils, or selective geometry in the shape of the coils must be used in the resin encapsulated method to prevent movement of the coils caused by the forces of short circuit faults. An added benefit is that by having greater mass, there is a longer thermal time constant with the solid cast type coils and there is better protection against short term overloads. The resin encapsulated method does however have several distinct advantages over solid cast coils. They are simpler to manufacture and require less resin and other materials, resulting in less weight and lower costs. Additionally, the cast resin process requires an epoxy resin which also requires fillers such as glass fibers to provide mechanical strength. The epoxy resins generally are limited to a 185 deg.C. temperature, whereas resin encapsulated coils can utilize polyester resins which can achieve 220 deg.C. ratings. Given these advantages, it would be desirable to produce transformers with the resin encapsulated method if there were a method to increase the strength of the coil windings to prevent movement during short circuits. It would also be advantageous to provide better insulation at the top and bottom portions of the coils to prevent moisture and other environment contaminants from deteriorating the windings.

The air gap between the high and low voltage coils is dependent on having the same geometry between the outer surface of the inner coil and the inner surface of the outer coil. A large factor on the shape of the coil is the method of attaching the external leads to the winding. For non-molded coils, there is generally a distinct bulge at the point where this occurs. As a result, the air gap between coils will be uneven. Inductive reactance of a transformer is determined by this air gap, along with the number of turns in the coil and the physical dimensions of the coil. Controlling these factors will result in limiting short circuit currents and thus controlling withstand ratings.

SUMMARY OF THE INVENTION

Accordingly, the principal object of the present invention is to provide a transformer with a high voltage winding utilizing a cast resin method and a low voltage winding constructed according to the resin encapsulated method which overcomes the above mentioned disadvantages.

A further objective of the invention is to provide a method for manufacturing a transformer winding constructed according to the resin encapsulated method which prevents moisture penetration into the windings and which will prevent flashovers due to moisture condensation.

Yet a further objective of the invention is to provide a transformer winding constructed according to the resin encapsulated method utilizing aluminum strip wound secondary windings which will prevent conductor movement during short circuit fault conditions.

Another objective of the invention is to provide a transformer winding constructed according to the resin encapsulated method which will maintain shape and dimension integrity, while facilitating thermal conductivity and improving dielectric strength.

In addition, another objective of the invention is to provide a method for manufacturing a transformer winding constructed according to the resin encapsulated method which produces an essentially circular winding that does not have a bulge due to external lead attachments.

Still another objective of the invention is to provide a method for manufacturing a transformer core which will have a constant, uniform compression applied throughout the length of the core legs, resulting in an improved coil loading procedure, reduced core losses, and reduced core audible noises.

In one embodiment of the invention, the inner or low voltage coil is formed on a special cylinder or mandril with a flat surface on a portion of the cylinder from which one external lead which is welded to a conductor sheet, such as aluminum or copper, will rest on during the start of the winding. The flat surface will allow the windings to retain a circular shape. Along with the aluminum, a layer of insulating material will be including during the winding process. The insulating material will have a pattern of thermo-set or B-stage adhesive coated on it that will prevent movement of adjacent windings during the resin impregnation process and will allow the various windings to retain a circular shape. The resin will be able to provide a better bond between windings since the various windings are held in place while processing. This bonding will provide extra strength to the windings and prevent movement of them under short circuit conditions. At a predetermined number of turns, spacers will be added to form air channels within the windings and the process will be repeated until the desired number of turns has been reached. The end of the winding will terminate at another flat surface and the other external lead will be attached to maintain the circular shape.

After the coil is thusly assembled, it will be subjected to a vacuum-pressure impregnation (VPI) process. This process starts with the coil first being pre-heated in an oven to remove moisture from the insulation and the aluminum windings. The coil is then placed in a vacuum chamber which will be evacuated, which will remove any remaining moisture and gases, and in particular, voids between adjacent windings will be essentially eliminated. A liquid resin is then introduced into the chamber, still under a vacuum, until the coil is completely submerged. After a short time interval which will allow the resin to impregnate the insulation, the vacuum is released and pressure is applied to the free surface of the resin. This will force the resin to impregnate the remaining insulation voids. The coil is then removed from the chamber or the resin from the chamber is drained. The coil is then allowed to drip dry and then is placed in an oven to cure the resin to a solid. A further buildup of resin could be accomplished by repeating the process with resins having a higher viscosity to provide the finished coil with a conformal coating for a better appearance and greater isolation from environmental factors. The completed coil will have superior basic impulse level (BIL) protection since there are essentially no voids, short circuit withstandability is improved since there is little chance of the individual windings moving due to the bonding, and overload capacity is increased since heat generated in the windings will transfer to the cooling ducts better through a solid mass than if voids were present in the windings.

The outer coil or high voltage coil is a cast resin coil and is also fabricated using a VPI process, with the chief difference being that the resin is poured into a mold containing the coil, allowing the curing to take place inside the mold. The transformer is then assembled by inserting the inner coil over an iron laminated core and then inserting the outer coil around the inner coil. The resultant assembly is then secured with appropriate clamps and mounting feet, along with terminal means for external connections.

Other features and advantages of the invention will be apparent from the following specification taken in conjunction with the accompanying drawings in which there is shown a preferred embodiment of the invention. Reference is made to the claims for interpreting the full scope of the invention which is not necessarily represented by such embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
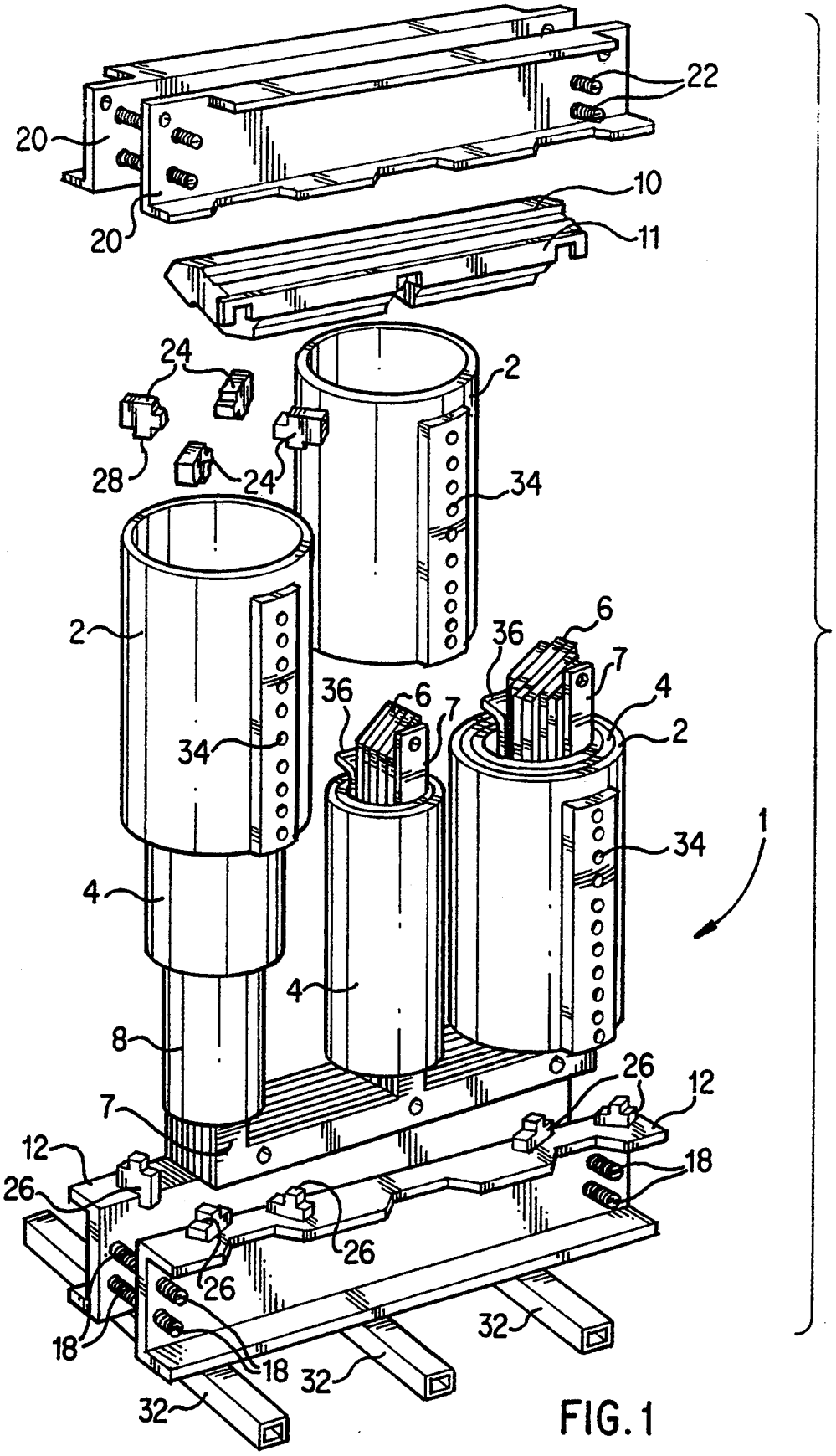
FIG. 1 is an exploded isometric view of a three phase dry-type high voltage transformer constructed according to the present invention.

FIG. 1 illustrates a typical three phase transformer 1 constructed according to the preferred embodiment. Although a three phase transformer is shown, it is to be understood that the invention is not to be limited to three phase construction. A high voltage coil 2 surrounds a low voltage coil 4. The high voltage coil 2 is constructed using a VPI cast resin process, the details of which are well known and are therefore not an object of this invention. U.S. Pat. No. 4,523,171 discloses one such method. The low voltage coil 4 is constructed using a VPI resin encapsulated process which will be discussed later. A core 6 is formed in the shape of a cruciform from laminated straps of iron for ease of manufacturing. A core locking strap 7 is added to the top of the stack. Previously, after the core legs 6 were stacked, a series of banding straps were used to keep the core legs compressed. During the loading of coils 2, 4, the bands were cut as they are lowered into position. This causes the core legs to expand, interfering with the procedure. The expanded core legs result in increased core noise and losses. A fiber glass tape could be wound around the core legs and then coated with a type of epoxy tape, but this increases manufacturing time and costs. To improve the method, instead of banding straps, core compression and stabilization is accomplished with the use of a heat shrink film material 8 with an elastic property that will hold the core leg in a constant uniform compression. The heat shrink material 8 Such as Dupont Mylar is wound around the core legs 6 and then heated to shrink the material 8 tightly around the the core legs. An alternative to the heat shrink material 8 is to use some other type of film material or narrow tape having elastic properties and wrapping the material under tension around the core legs 6 to keep them under compression. After the core legs are thusly secured, an epoxy type paint is applied to exposed areas for environmental protection. An upper core yolk 10 is secured to the core 6 by mating strap 11 with core locking strap 7 after the low voltage coils 4 and high voltage coils 2 have been inserted over the three legs of the core 6. Lower core clamp 12 holds and secures core 6 with mounting hardware 18. Upper core clamp 20 holds and secures upper core yolk 8 similarly with mounting hardware 22. Upper 24 and lower 26 mounting blocks support high voltage coil 2 and low voltage coil 4. Tab 28 of mounting blocks 24, 26 maintains an air gap 30 between the coils 2, 4. Mounting feet 32 can be attached for stability. Terminal blocks 34 allow for high voltage connections and have provisions for selected various voltage taps for a wide selection of input and output voltages. Terminals 36 provide the means for low voltage connections. A transformer thus assembled can accommodate input voltages up to 36 kV, with a power rating between 112.5–10,000 kVA.

Figure 2:
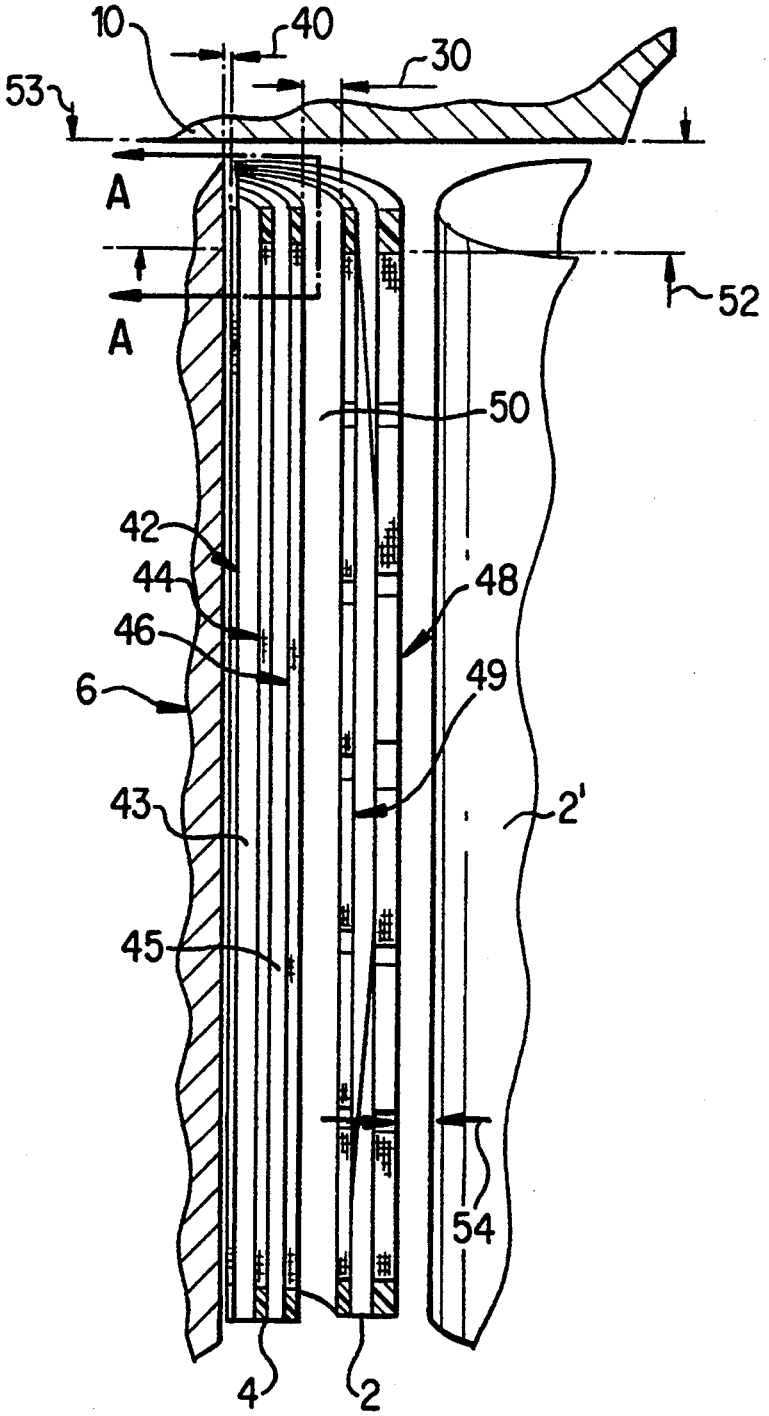
FIG. 2 is a partial cross sectional view of a core surrounded by a low voltage coil constructed according to the present invention, which in turn, is surrounded by a cast resin high voltage coil of the type depicted in the transformer of FIG. 1.

Referring to FIG. 2, a partial cross sectional view of the low voltage coil 4 is illustrated., constructed according to the present invention, which in turn is surrounded by a cast resin high voltage coil of the type depicted in the transformer of FIG. 1. An air gap 40 separates the core leg 6 from the low voltage coil 4. The low voltage coil 4 is composed of multiple windings 42, 44, 46 of flex sheet conductors such as copper or aluminum, with formed air channels 43, 45 to provide a means of cooling during operation of the transformer 1. Air gap 30 separates the low voltage coil 4 from the high voltage coil 2 with the distance of the gap being determined by the tab 28 on mounting blocks 24, 26 previously mentioned. High voltage coil 2 consists of wire conductors 48, 49, with molded air channels 50. The distance 52 between the top of the conducting materials in coil 2 and the top yolk 10 is chosen to meet high voltage to frame clearances. Likewise, the distance 53 between the top of the conducting materials in coil 4 and the top yolk 10 is chosen to meet the low voltage to frame clearances. Air gap 54 provides isolation between voltage phases.

Figure 3:
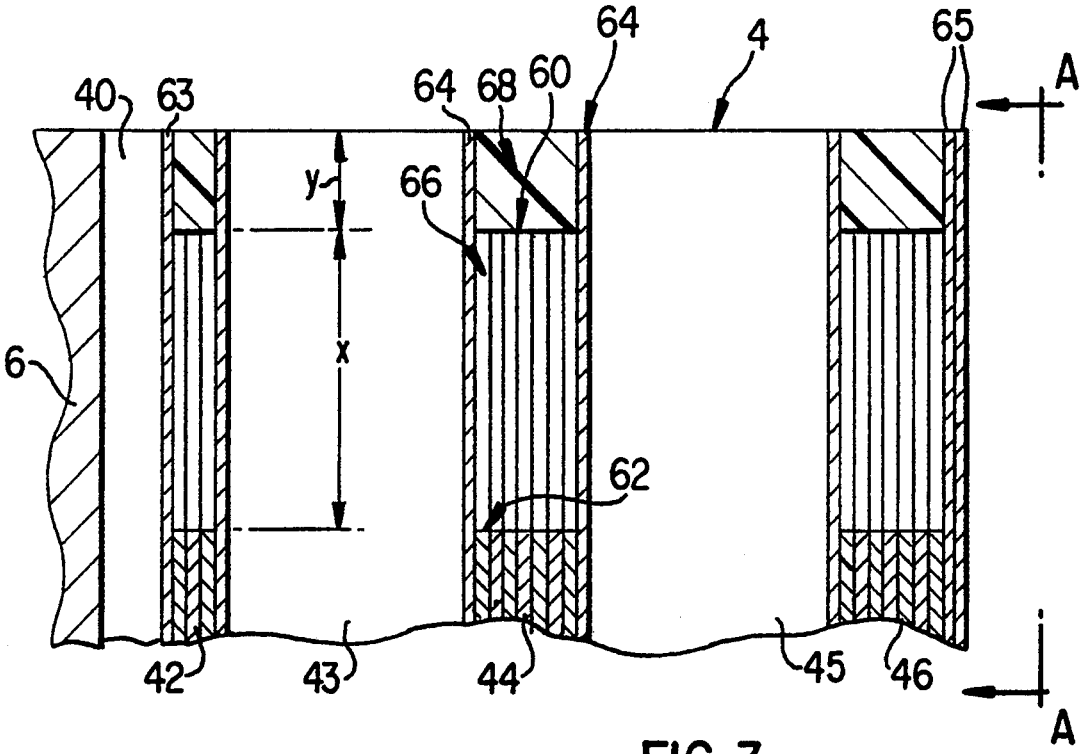
FIG. 3 is a cross sectional view along line A—A of the low voltage coil of FIG. 2.

A more detailed view of section C—C of FIG. 2 is shown in FIG. 3 to illustrate a means for reinforcing the top and bottom edges of the windings 42, 44, 46 of the low voltage coil 4. The low voltage coil 4 is composed of multiple laminations of flex sheet conductors. The description for winding 44 will also hold true for the other two windings 42 and 46. Film insulation sheets such as Nomex form an excellent winding layer insulation system. This layer 60 is extended beyond the edge of the sheet conductors 62, as designated by the distance X for obtaining the necessary creep strength requirements. When winding the insulating layers 60 with the sheet conductors 62, the edges of the layers 60 can collapse due to the soft texture of the material, which could result in blockage of the cooling ducts, limiting the cooling characteristics of the coil. Outside barriers 64 which extend a distance Y beyond the edge of the insulating layers 60, provide the stiffness to prevent this collapse and are selected based on the voltage class of the transformer. For a minimum of a basic impulse level (BIL) of 10 kV, common for an isolation rating between the core 6 and the low voltage coil 4, the inside barrier 63 will be one thickness of 0.031 inch sheet insulation such as a product trademarked Glastic plus two pieces of another insulator, 5 mil thick, such as a product trademarked Nomex. For a minimum BIL of 95kV, common for an isolation rating between the high voltage coil 2 and the low voltage coil 4, the outside barrier 65 will be two thicknesses of 0.031 inch sheet insulation. The space between the insulating layers 60 is packed with a glass mat or felt edge material 66 to control the movement of the sheet conductors 62 during short circuit conditions. The glass felt edge material 66 could be any type of porous dielectric characterized by high temperature rating and stability. The dielectric constant must be greater than air to maintain proper voltage gradients between the core or frame and the high voltage conductors. Examples of such a material 66 are Nomex 411, Cequin or other types of glass fibrous material. This material 66 functions to provide protection to the sheet conductors 62 against water entry or other contaminants and to provide electrical insulation properties for withstanding high voltage transients, in addition to providing the mechanical rigidity of the ends of the coil for mechanical clamping and short circuit withstand forces. The material 66 must allow the sheet conductors to be impregnated with a suitable electrical insulating resin during the VPI process.

Figure 4:
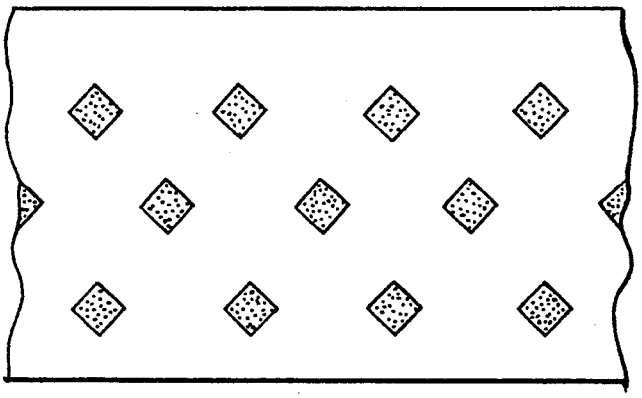
FIG. 4 is a sectional view of the insulating material detailing the placement of adhesive material used in the low voltage coil of the transformer of FIG. 1.

The insulating layers 60 are coated with a diamond pattern B-staged-thermoset adhesive as shown in FIG. 4. A variation of this type of arrangement have been used with oil-filled distribution type transformers to facilitate the oil impregnation process. The short circuit strength of a strip wound coil can be greatly increased by bonding together the layers of the sheet conductors 62 during the VPI process with a heat cured resin adhesive. During this process however, the shape of the coil can become distorted due to thermal stresses. Use of the thermoset adhesive allows the layers to become bonded during a preheating process before the VIP process. The diamond pattern will create sufficient bonding between the sheet conductors 62 to retain the shape of the coil during the VPI process and still provide sufficient unbonded areas for the resin to impregnate the body of the coil during the VPI process. The resultant coil will have greater short circuit withstandability and improved radial heat conduction due to bonding throughout the body of the coil. The type of resin is chosen to provide a suitable temperature index for the intended temperature rise of the coils. In addition it must be able to fill the voids and improve the thermal conduction between the sheet conductors 62 and the heat dissipating surfaces, and lastly, prevent contaminants such as water, oils, acids, and industrial fumes from entering and contaminating the coils. One such resin is tradenamed PD George 70 red color resin. After VPI processing the completed coil is then baked in an oven at 350 deg. F. for two hours. An air dry resin is then applied in the void 68 to contour the ends of the windings, eliminating voids, and facilitating moisture run-off.

Instead of using the dry resin, other coil finishing treatments and extensions can be employed in the void 68. A moisture cured silicone RTV, an epoxy resin having suitable cure characteristics for the application, or a filled polyester resin could be substituted for the dry resin. Another option requires a woven or braided fibrous rope being placed in the void 68 before the coil is subjected to the VPI process. The rope could be made of glass fiber, Nomex, or other heat resistant material.

Figure 5:
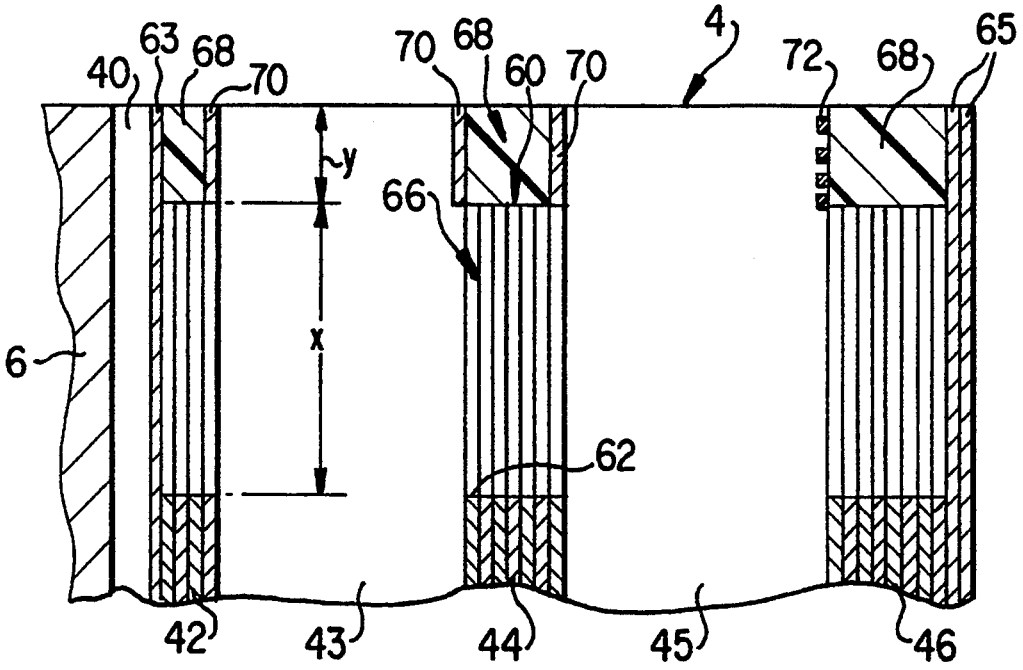
FIG. 5 is a partial cross sectional view of the low voltage coil of the transformer of FIG. 1 detailing an alternative method of reinforcing the edges of the insulating material.

Supporting the outside layers next to the air channels 43, 45 of the multiple windings 42, 44, 46 with the outside barriers 64 results in increasing the overall radial dimensions of the windings and therefore the overall dimensions of the completed transformer 1. This extra thickness translates into extra material requirements for the core and coil material, including the conductors, insulating film, and resin used to encapsulate the windings. An alternative solution is to provide a reinforcing material along the edges of the outer insulating layers 60 next to the air channels 43, 45, for the distance Y, that will provide the stiffness to prevent this collapse of the edges. Thus, FIG. 5 illustrates the use of Cequin strips 70 or reinforcing nylon strands 72 which will maintain the circular shape of the completed coil during the VPI processing and prevent the collapse over the air channels 43, 45. The end result will be a finished coil that will have a smaller diameter than one manufactured using the traditional glastic material, using less material and therefore having lower cost.

Figure 6:
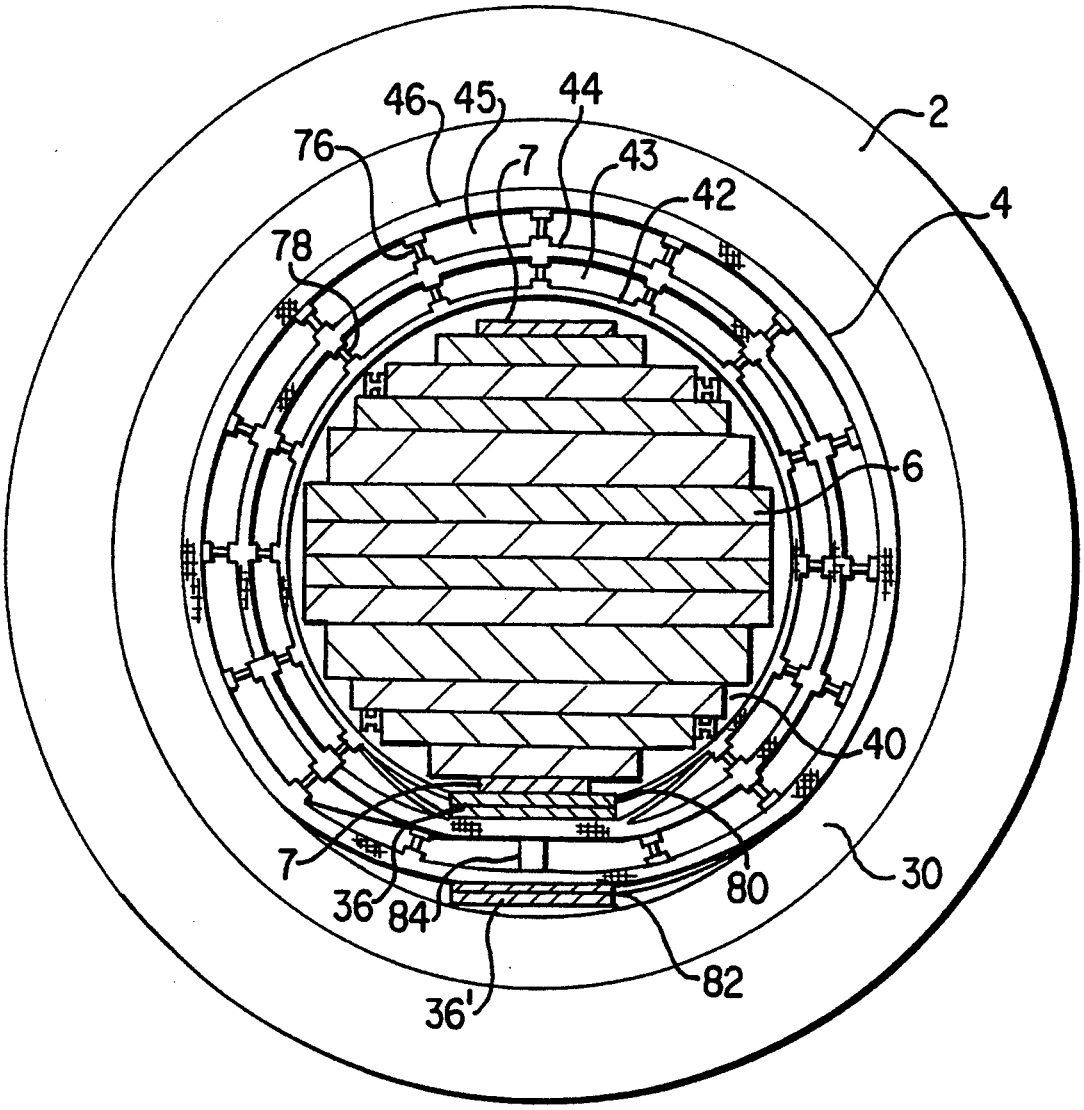
FIG. 6 is a detailed cross sectional view of the low voltage coil of FIG. 2.

The cross sectional view of FIG. 6 provides a more detailed illustration of the preferred embodiment of the low voltage coil 4 construction of the present invention. The outer or high voltage coil 2 is separated from the low voltage coil 4 by the air gap 30. The essentially circular shape of the low voltage coil 4 allows the air gap 30 to remain constant throughout its entirety which will reduce susceptibility to voltage impulses and will help control impedance changes during short circuit conditions. Air gap 40 separates the cruciform core leg 6 from the low voltage coil 4. The low voltage coil 4 is composed of multiple windings 42, 44, 46 of flex sheet conductors such as copper or aluminum, with formed air channels 43, 45 to provide a means of cooling during operation of the transformer 1. Dogbone spacers 76, 78 are staggered and strategically placed and sized so as to enable the final exterior shape at the air gap 30 is circular. The spacers 76, 78 are protruded glass reinforced polyester. Spacing between adjacent spacers 76, 78 varies from 1.5 inches to 2.5 inches on center. This spacing is critical since air flow in the created air ducts 43, 45 will be restricted if they are too close together, resulting in poorer cooling characteristics. If the spacing is too far, voids could be created between the insulating layers 60 and the sheet conductors 62 that make up the windings 42, 44, 46. This could result in localized hot spots and decrease the mechanical rigidity of the over coil 4, which could reduce the short circuit withstandability.

The coil is wound from flexible sheet conducting material start at a flat surface 80. Multiple laminations of flex sheet conductor lead are used to form the external leads 36, 36' which are welded to the sheet conductor 62. The leads 36, 36' are deformed during assembly to allow the high voltage coil 2 to be inserted around the coil during final assembly of the transformer 1 and reshaped appropriately after assembly for external connects. Leads 36, 36' are insulated with a creep and strip barrier composed of Nomex or other suitable flexible sheet insulation. This insulation is to prevent voltage breakdown between the low voltage winding 4 and the core 6 or other grounded surfaces. The combination of the flat surfaces 80, 82, and duct stick 84 allow the leads 36, 36' to be contained inside the low voltage coil 4 with no apparent bulge. In addition the leads 36, 36' are bonded to the body of the low voltage coil 4. A glass rope or other suitable material, running parallel to the lead from top to bottom along its major axis is sufficiently porous to absorb resin during the VPI process to provide lead support and reinforcement, preventing movement of the lead from short circuit forces.

While the specific embodiments have been illustrated and described, numerous modifications are possible without departing from the scope or spirit of the invention.

We claim:

1. A dry-type transformer having a plurality of phases, said transformer comprising;

a. an iron core having a leg for each of said plurality of phases;

b. a cylindrical solid cast resin high voltage coil functioning as a primary winding for each of said plurality of phases;

c. a cylindrical resin encapsulated low voltage coil functioning as a secondary winding for each of said plurality of phases;

d. wherein said low voltage coil includes multiple turns of a conductor sheet material coincident with an insulating sheet material and further including means for forming cooling channels interposed in said multiple turns;

e. wherein said low voltage coil includes means for bonding each of said multiple turns of conductor sheet material with an adjacent turn of said multiple turns of conductor sheet material, said bonding means to prevent movement of said conductor sheet material during short circuit conditions; and f. wherein for each of said plurality of phases, said low voltage coil is placed over and around said leg of said iron core, and said high voltage coil is placed over and around said low voltage coil.

2. A dry-type transformer having a plurality of phases, said transformer comprising:

a. an iron core having a leg for each of said plurality of phases;

b. a cylindrical solid cast resin high voltage coil functioning as a primary winding for each of said plurality of phases and including termination means for connecting to a high voltage AC source;

c. a cylindrical resin encapsulated low voltage coil functioning as a secondary winding for each of said plurality of phases and including termination means for outputting a lower AC voltage; and d. wherein for each of said plurality of phases, said low voltage coil is placed over and around said leg of said iron core, and said high voltage coil is placed over and around said low voltage coil.

3.The dry-type transformer of claim 2 wherein said low voltage coil includes multiple turns of a conductor sheet material coincident with an insulating sheet material and further including means for forming cooling channels interposed in said multiple turns.

4. The dry-type transformer of claim 3 wherein said low voltage coil further includes means for bonding each of said multiple turns of conductor sheet material with an adjacent turn of said multiple turns of conductor sheet material, said bonding means to prevent movement of said conductor sheet material during short circuit conditions.

5. The dry-type transformer of claim 2 wherein said iron core is formed in a cruciform shape from laminated straps of iron.

6. The dry-type transformer of claim 5 wherein said iron core includes means to prevent said laminated straps of iron from expanding during assembly of said coil.

7. The dry-type transformer of claim 6 wherein said means to prevent expansion of said laminated straps of iron is a heat shrink film material with elastic properties.

8. The dry-type transformer of claim 2 wherein said conductor sheet material is aluminum.

9. The dry-type transformer of claim 2 wherein said conductor sheet material is copper.

10. The dry-type transformer of claim 2 wherein said low voltage coil is resin encapsulated by a vacuum-pressure impregnation process.

11. The dry-type transformer of claim 2 wherein said bonding means of each of said multiple turns of conductor sheet material with an adjacent turn of said multiple turns of conductor sheet material utilizes a thermoset material coating on said insulating material, said thermoset material for bonding during a preheating process before said resin encapsulation of said low voltage coil.

12. The dry-type transformer of claim 11 wherein said thermoset material coating on said insulating material is in a diamond shaped pattern.

13. The dry-type transformer of claim 2 wherein said iron core has three legs, said transformer functional as a three phase transformer.

14. A method of manufacturing a dry-type transformer having a plurality of phases, said method comprising:

a. forming an iron core having a leg for each of said plurality of phases;

b. forming a cylindrical high voltage coil using a solid cast resin method for each of said plurality of phases, said high voltage coil functioning as a primary winding for each of said plurality of phases and including termination means for connecting to a high voltage AC source;

c. forming a cylindrical low voltage coil using resin encapsulated method for each of said plurality of phases, said low voltage coil functioning as a secondary winding for each of said plurality of phases and including termination means for outputting a lower AC voltage; and d. placing said low voltage coil over and around said leg of said iron core for each of said plurality of phases; and e. placing said high voltage coil over and around said low voltage coil for each of said plurality of phases.

15. The method of manufacturing a dry-type transformer of claim 14 wherein said forming of said low voltage coil includes multiple turns of a conductor sheet material coincident with an insulating sheet material and further includes forming cooling channels interposed in said multiple turns.

16. The method of manufacturing a dry-type transformer of claim 14 wherein said low voltage coil further includes bonding each of said multiple turns of conductor sheet material to an adjacent turn of said multiple turns of conductor sheet material, said bonding to prevent movement of said conductor sheet material during short circuit conditions.

17. The method of manufacturing a dry-type transformer of claim 14 wherein said forming of said iron core is formed in a cruciform shape from laminated straps of iron, said method further including wrapping said legs with a heat shrink film material with elastic properties to prevent said laminated straps of iron from expanding during assembly of said coil.

18. The method of manufacturing a dry-type transformer of claim 14 wherein said iron core is formed with three legs, said transformer functional as a three phase transformer.

* * * * *